United States Patent [19]

Fleischhauer

[11] Patent Number: 4,894,883

[45] Date of Patent: Jan. 23, 1990

[54] DOOR CLOSERS

[76] Inventor: Eugene T. Fleischhauer, 1413 Wesanne La., Midlothian, Va. 23113

[21] Appl. No.: 7,514

[22] Filed: Jan. 28, 1987

[51] Int. Cl.[4] ..... E05F 3/00

[52] U.S. Cl. ..... 16/66; 16/84; 16/DIG. 10; 16/DIG. 17

[58] Field of Search ..... 16/49, 66, 84, DIG. 9, 16/DIG. 10, DIG. 17

[56] References Cited

U.S. PATENT DOCUMENTS

| | | | |
|---|---|---|---|
| 1,287,443 | 12/1918 | Rosentreter | 16/84 |
| 2,940,111 | 6/1960 | Patriquin | 16/66 |
| 3,090,988 | 5/1963 | Truhon | 16/66 |

*Primary Examiner*—Richard K. Seidel
*Attorney, Agent, or Firm*—Hughes & Multer

[57] ABSTRACT

Automatic door closers have a latch mechanism for holding the door open. In one mode of operation, the latching of the door is effected automatically when the door is opened. Tapping the door closer cylinder upwardly releases the latch mechanism and allows the door to close. Manual manipulation of the latch mechanism is required to latch the door open in a second mode of operation. However, in this mode of operation, the latch mechanism can be released simply by opening the door slightly beyond its latched position. The door closer includes a cylinder with a rectilinearly displaceable piston rod housed therein and extending through one cylinder head; and the latch mechanism comprises that cylinder head and a notch in the piston rod into which cylinder head is fitted to keep the piston rod from telescoping into the cylinder. The opposite end of the cylinder and the exposed end of the piston rod are attached to the door and the door frame. Consequently, the door cannot close as long as the piston rod is kept from telescoping into the cylinder by the latch mechanism.

2 Claims, 3 Drawing Sheets

DOOR CLOSERS

TECHNICAL FIELD OF THE INVENTION

This invention relates to door closers and, in particular, to improvements in door closers for screen doors, storm doors, and the like.

BACKGROUND OF THE INVENTION

Described in the prior art are screen door and storm door closers which embody means for holding side pivoted doors open against the closing action of a door check. This closing action of the door check is effected by a coil spring which is compressed when the door is opened.

Such door closing door checks usually consist of a cylinder connected at one end to either the door frame or the door, a spring loaded piston rectilinearly displaceable in the cylinder, and a piston rod fixed to the piston and extending from the other end of the cylinder. The exposed or free end of the piston is pivotally connected to the other of the door frame and the door.

Air enters the cylinder freely as the door is opened. The air escapes at a controlled rate through a suitable orifice as the door is spring closed, thus checking the rate of speed at which the door is closed by an air cushion or damping action.

The more advanced of these prior art door closes have a mechanism for holding the door open after it has been manually swung to the open position. This is a significant convenience for a person carrying an armload of parcels or a person moving furniture through a doorway, for example. On such door closer is disclosed in U.S. Pat. No. 3,090,988 issued May 28, 1963, to Truhon for DOOR CLOSING DOOR CHECKS.

Notwithstanding the added convenience they provide, door closers such as those disclosed in the just-cited Truhon patent have not found their way onto the market to any substantial extent. This is because the components added to the door closer to enable it to hold a door open increase the cost of the door closer to a level which has proven to be unacceptable.

SUMMARY OF THE INVENTION

I have now invented, and disclosed herein, certain new and novel, spring-operated door closers which have the just-discussed ability to hold a door open but are capable of accomplishing this without any parts beyond those found in a door closer which does not have the capability in question. Instead, a notch formed in the piston rod of the door closer is caused to engage an end cap of the door closer cylinder when the door equipped with the closer is swung to its open position. This engagement can be effected either automatically or manually at the option of the user. If effected automatically, the piston rod is released manually, allowing the closer to close the door. And, in the manual operating mode, the piston is freed with the same result by opening the door slightly wider and then releasing it.

OBJECTS OF THE INVENTION

From the foregoing it will be apparent to the reader that the primary object of the present invention resides in the provision of novel, improved door closers which have the capability of holding the doors with which they are associated in an open position or orientation.

Another primary and equally important object of the invention resides in the provision of door closes in accord with the preceding object which are provided with the capability of holding a door open without employing additional parts.

And a related and also important object of the invention resides in the provision of door closers of the character in question in which the operation of the hold-open mechanism can be effected automatically or manually at the option of the user.

Other important objects and features and additional advantages of the invention will be apparent to the reader from the foregoing and the appended claims and as the ensuing detailed description and discussion of my invention proceeds in conjunction with the accompanying drawing.

DETAILED DESCRIPTION OF THE INVENTION

Figure 1:
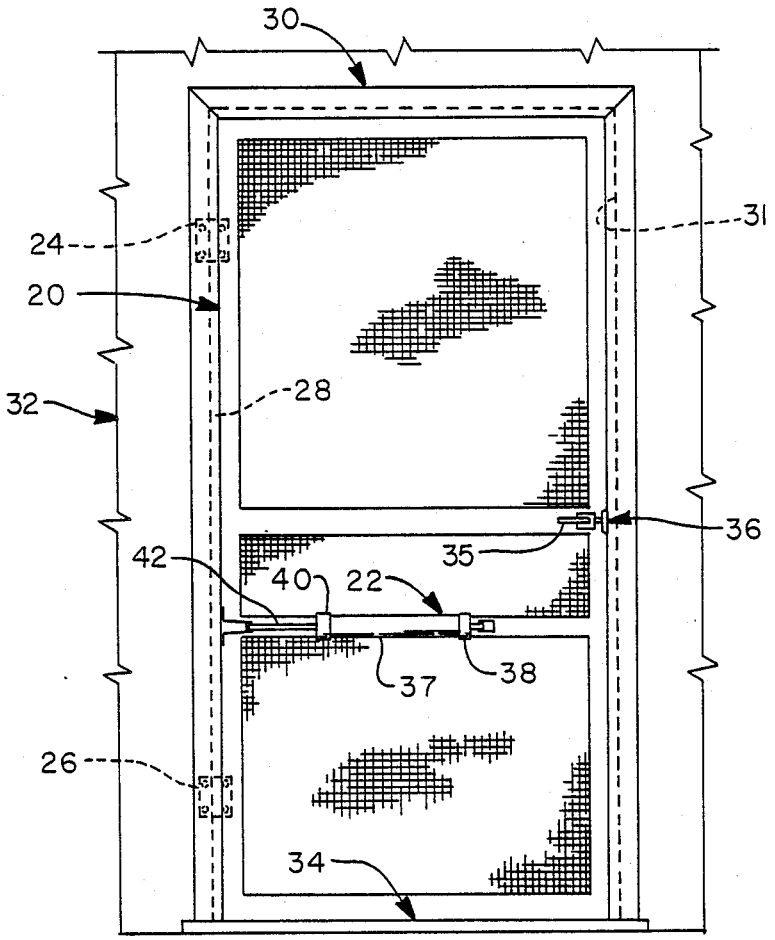
FIG. 1 is an elevation of a screen door equipped with a pneumatically damped door closer embodying the principles of the present invention, the door being shown in the closed position.
Figure 2:
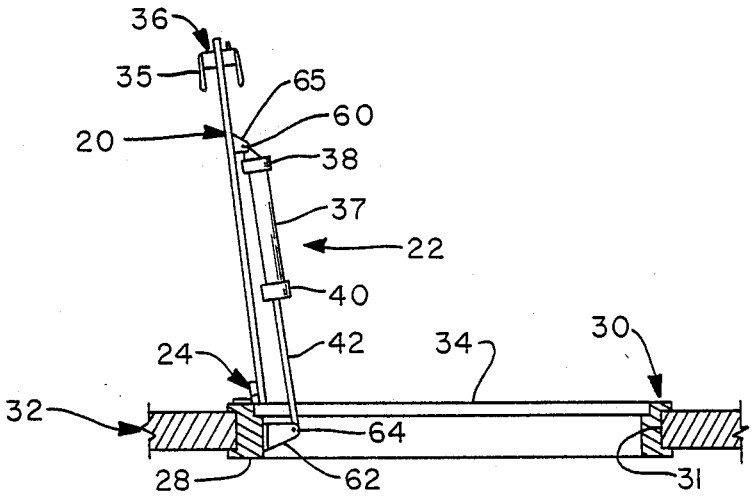
FIG. 2 is a top view of the door shown in FIG. 1 with the door being shown in the open position in which it is held by the door closer of FIG. 1.

Referring now to the drawing, FIGS. 1 and 2 diagrammatically depict a door 20 equipped with a pneumatically damped door closer 22 embodying the principles of the present invention.

Door 20 is fixed by hinges 24 and 26 to one vertical side member 28 of a door frame 30. The door frame is set in an opening 31 through a wall 32 above a sill 34. The door can accordingly be swung between the closed position shown in FIG. 1 and the open position illustrated in FIG. 2 by the handle 35 of a latch 36 which is employed to secure the door in its closed, FIG. 1 position.

Door 20 is automatically returned from an open position such as that shown in FIG. 2 to the closed position of FIG. 1 at a controlled rate, and also maintained in the open position shown in FIG. 1, by door closer 22.

Figure 3:
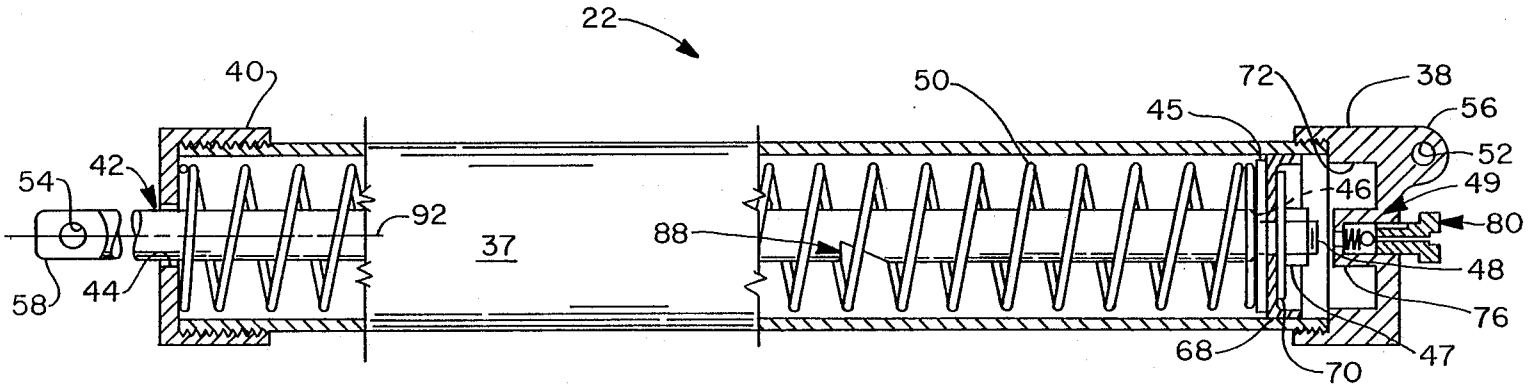
FIG. 3 is a side view of the door closer in the retracted configuration it has when the associated door is closed, part of the door closer external casing being cut away to show its internal components.
Figure 4:
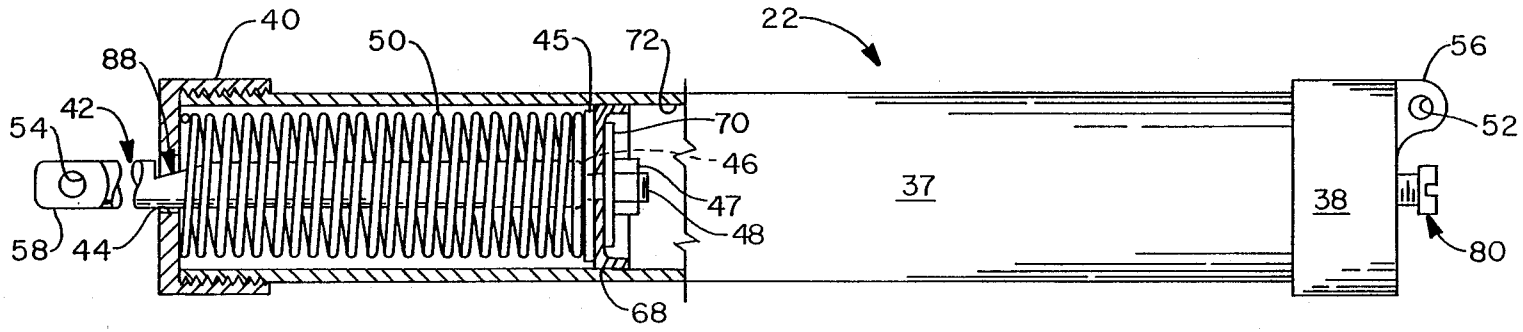
FIG. 4 is a view similar to FIG. 3 but with the door closer in an extended configuration in which it is automatically latched and thereby made capable of holding a door in an open position such as that shown in FIG. 2.
Figure 5:
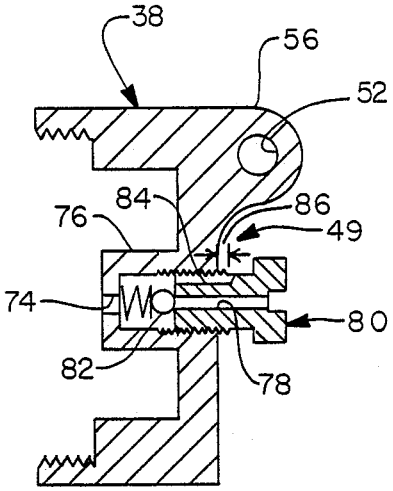
FIG. 5 is a fragment of FIG. 3 to an enlarged scale.

As is shown in FIGS. 3–5, the major components of door closer 22 include: an elongated cylinder 37; cylinder heads 38 and 40 threaded onto the opposite ends of cylinder 37; a piston rod 42 which is rectilinearly displacable in cylinder 37 and extends through a circular, central aperture 44 in cylinder head 40; and a piston 45 which is trapped against a shoulder 46 on the inner end 48 of piston rod 42 as by a nut 47. The door closer also includes: a pneumatic damping system 49 for controlling the rate-of-movement of door 20 toward opening 31 by regulating the escape from cylinder 37 of air trapped in that cylinder between piston 45 and cylinder head 38 and a coil spring 50 which continuously urges piston rod 42 toward the retracted relationship in cylinder 37 shown in FIG. 4, thereby biasing door 20 toward the closed position shown in FIG. 2.

Apertures 52 and 54 are respectively formed through a mounting lug 56 protruding from cylinder head 38 and through the flattened, exposed end portion 58 of piston rod 42. A pin 60, extending through aperture 54, pivotably connects that end of door closer 22 terminating in piston rod 42 to a bracket 62 fixed in any convenient fashion to door frame side member 28. The opposite end of the door closer terminating in mounting lug 56 is similarly pivotably connected by a pin 64 extending through aperture 52 to a bracket 65 mounted on door 20.

As shown in FIGS. 3 and 4, a seal 68, is tightly fitted on piston rod 42 and trapped between piston 45 and a washer 70 by nut 47, spans cylinder 37. This provides an essentially gas-tight chamber 72 in the interior of cylinder 37 between piston 45 and cylinder head 38.

As door 20 is opened and piston 45 and piston rod 42 consequently move to the left as shown in FIGS. 3 and 4, ambient air flows freely into chamber 72 through: a central passage 74 in an integral boss 76 extending inwardly from cylinder head 38 and a cooperating, internal passage 78 in an adjusting screw 80 threaded into boss 76.

As indicated above, door 20 is closed by the expansion of spring 50 from the "door open," compressed configuration shown in FIG. 4 in which potential energy is stored in the spring to the "door closed," relaxed configuration shown in FIG. 3. Spring 50 surrounds piston rod 42 and extends between cylinder head 40 and the washer 70 trapped against shoulder 46 at the inner end 48 of the piston rod by nut 47.

During the closing of door 20 and the movement of piston rod 42 and piston 45 toward the retracted position shown in FIG. 3, a spring loaded ball valve 82 (best shown in FIG. 5 and a component of pneumatic damping system 49) is forced against the inner end of adjusting screw 80 by air forced through the aperture 74 in boss 76. This closes the passage 78 through adjusting member 80. Therefore, air can escape from chamber 72 only through a slot 84 extending along the periphery of the adjusting screw.

The rate at which the air escapes can be controlled by threading screw 80 inwardly and outwardly to change the size of the opening 86 between screw 80 and cylinder head 38 through which the air escapes. By threading screw 80 inwardly, the size of opening 86 can be reduced, restricting the flow of air from chamber 72 and increasing the damping of spring 50. This reduces the speed with which door 20 closes. Conversely, by threading screw 80 outwardly, the size of opening 86 can be increased, allowing air to escape more rapidly from chamber 72 and thereby allowing door 20 to close faster.

Referring now primarily to FIGS. 3, 4, 6, and 7, the novel mechanisms I employ in door closure 22 to maintain door 20 in the open position shown in FIG. 2 includes a notch 88 formed in piston rod 42. That notch has one steep face 90 which extends transversely (or at right angles) relative to the longitudinal axis 92 of the piston rod and a second, more gradually sloping face 94. The steeper, transversely extending face 90 of notch 88 is designed to engage the outer side 96 of cylinder head 40. This retains piston rod 42 in the extended position which that piston rod assumes when door 20 is pivotably dispaced to the open position shown in FIG. 2.

Figure 6:
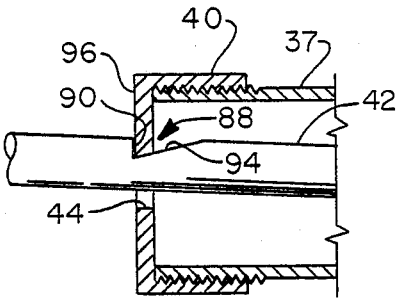
FIG. 6 is a fragment of FIG. 3 showing a piston rod incorporated in the door closer so oriented that the door closer is capable of being automatically latched to hold the door in the open position.

Piston rod 42 may be oriented with notch 88 facing upwardly as shown in FIGS. 4 and 6. This allows the left-hand cylinder head 40 of door closer 22 to drop into notch 88 when door 20 is opened to the position shown in FIGS. 2. When the door is thereafter released, spring 50 will tend to pull piston rod 42 to the right as shown in the same Figure. This engages notch face 90 with the outer side 96 of cylinder head 40. As a result, piston rod 42 is kept from moving to the left; and, door 20 remains in the open position shown in FIG. 2.

To release piston rod 42 and allow spring 50 to close door 20, it is necessary only to press or tap up that end of cylinder 37 bearing cylinder head 40 until the cylinder head clears face 90 of notch 88. Thereafter, piston rod 42 can move relative to cylinder 37; and spring 50 can consequently expand to displace door 20 to its closed, FIG. 1 position.

Figure 7:
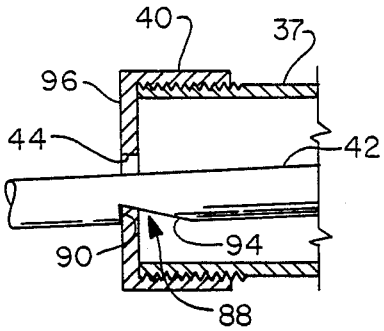
FIG. 7 is a view similar to FIG. 6 but showing the piston rod of the door closer reoriented so that the door closer is capable of being manually latched to hold the door in the open position.

As shown in FIGS. 3 and 7, piston rod 42 and piston 45 can also be rotated in cylinder 37 until notch 88 faces downwardly rather than upwardly. With notch 88 in that orientation, door 20 can be latched in the open position shown in FIG. 2: (1) by first displacing the door to the open position, thereby aligning notch 88 with the outer side 96 of cylinder head 40; (2) moving the left-hand end of door closer 22 upwardly to position the transversely extending, steep face 90 of notch 88 opposite the outer side 96 of cylinder head 40; and (3) then releasing door 20 to engage the notch face with the cylinder head.

This mode of operation of door closer 22 has the advantage that piston rod 42 can be released to allow door 20 to close simply by opening door 20 slightly beyond the latched position. This allows the left-hand end of the door closer 22 to drop downwardly, freeing cylinder head 40 from notch 88 so that spring 50 can retract the piston rod and close door 20.

The upward and downward movements of cylinder 37 described above and needed to latch and unlatch piston rod 42 are accommodated by employing apertures 52 and 54 in mounting lug 56 and the exposed end of piston rod 42 which are significantly larger in diameter than the pins 60 and 64 fitted through those apertures.

Figure 8:
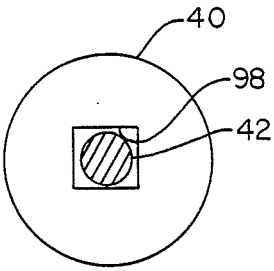
FIG. 8 depicts an alternate configuration of an aperture in an end cap of the door closer cylinder through which the piston rod of the door closer extends and with which the piston rod cooperates to latch the door closer in its extended configuration.

Many variations of my invention may of course be made within the scope of the principles adduced herein. For example, as shown in FIG. 8, a rectangular aperture 98 may be employed in the cylinder head 40 of door closer 22 in lieu of the circular aperture discussed above. The square aperture has the advantage that it increases the bearing surface between the transversely extending face 90 of piston rod notch 88 and cylinder head 40. This reduces the possibility that the cylinder head might slip out of notch 88 at an inopportune moment.

Still other variants will be obvious to those skilled in the arts to whom this specification is addressed.

Thus, it will be clear to the reader that the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

I claim:

1. A door closer comprising: an elongated cylinder; a first attachment means at one end of said cylinder; a piston rod slidably mounted in and extending from the opposite end of said cylinder, said piston rod and said cylinder being tiltable relative to each other in a vertical direction; a centrally apertured cylinder head at said opposite end of said cylinder, said piston rod extending through the aperture in said cylinder head; second attachment means at the exposed end of said piston rod; means continuously urging said piston rod toward a retracted relationship relative to said cylinder; and means for maintaining said piston rod in an extended relationship relative to said cylinder, the means for maintaining said piston rod in said extended relationship relative to said cylinder comprising a notch in said piston rod, said notch having a transversely extending face engageable with the exposed side of said cylinder head when a door to which said closer is attached is opened to extend said piston rod relative to said cylinder and said piston rod is thereafter tilted to align said transversely extending notch face with said exposed side of said cylinder head and said piston rod being rotatable in said cylinder about the longitudinal axis of the cylinder, whereby said piston rod can be rotated: (a) into a first position in which said notch faces downwardly, whereby said cylinder can be tilted upwardly relative to said piston rod to engage said transversely extending notch face with said exposed side of said cylinder head when a door to which the door closer is attached is opened to extend said piston rod relative to said door closer cylinder and thereby position said transversely extending notch face opposite said exposed face of said cylinder head; and (b) a second position in which said notch faces upwardly and said cylinder can tilt downwardly relative to said piston rod to engage said transversely extending notch face with said exposed side of said cylinder head when a door to which said door closer is attached is opened to extend said piston rod relative to said door closer cylinder and position said notch face opposite said exposed side of said cylinder head.

2. A door closer as defined in claim 1 wherein the aperture in said cylinder head has a rectangular configuration.

* * * * *

UNITED STATES PATENT AND TRADEMARK OFFICE

CERTIFICATE OF CORRECTION

PATENT NO. : 4,894,883

DATED : 23 January 1990

INVENTOR(S) : Eugene T. Fleischhauer

It is certified that error appears in the above—identified patent and that said Letters Patent is hereby corrected as shown below:

Second column of abstract, line 14, after "which" insert --the--.

Column 1, line 29, "closes" should read --closers--.

Column 1, line 34, "On" should read --One--.

Column 1, last line, "closes" should read --closers--.

Column 3, line 26, "As shown in" should read --As is shown in--.

Signed and Sealed this

Fourth Day of June, 1991

*Attest:*

*Attesting Officer*

HARRY F. MANBECK, JR.

*Commissioner of Patents and Trademarks*